US005355207A

United States Patent [19]

Yano et al.

[11] Patent Number: 5,355,207

[45] Date of Patent: Oct. 11, 1994

[54] IMAGE FORMING APPARATUS EQUIPPED WITH A BINDING FUNCTION

[75] Inventors: Satoshi Yano, Imabari; Mitsuo Nomura, Kanazawa; Hiroyuki Arai, Osaka; Yoshifumi Ishii, Osaka; Ichiro Takahashi, Osaka, all of Japan

[73] Assignee: Mita Industrial Co., Ltd., Osaka, Japan

[21] Appl. No.: 131,496

[22] Filed: Oct. 4, 1993

Related U.S. Application Data

[62] Division of Ser. No. 790,765, Nov. 12, 1991, Pat. No. 5,275,520.

[30] Foreign Application Priority Data

Nov. 14, 1990 [JP] Japan ..... 2-310078
Nov. 14, 1990 [JP] Japan ..... 2-310079
Nov. 16, 1990 [JP] Japan ..... 2-312101

[51] Int. Cl.[5] ..... G03G 21/00

[52] U.S. Cl. ..... 355/324; 412/20; 412/900

[58] Field of Search ..... 412/33, 37, 900, 902, 412/8, 11; 355/324; 156/908

[56] References Cited

U.S. PATENT DOCUMENTS

| | | | |
|---|---|---|---|
| 4,129,471 | 12/1978 | Rome | 156/211 |
| 4,194,832 | 3/1980 | Tabayashi | 355/11 |
| 4,566,782 | 1/1986 | Britt et al. | 355/14 SH |
| 4,818,168 | 4/1989 | Battisti | 412/37 |
| 4,848,797 | 7/1989 | Vercillo et al. | 281/21.1 |
| 4,855,573 | 8/1989 | Vercillo et al. | 219/492 |
| 5,143,503 | 9/1992 | Ito et al. | 412/37 |

*Primary Examiner*—Mark Rosenbaum
*Assistant Examiner*—S. Thomas Hughes
*Attorney, Agent, or Firm*—Beveridge, DeGrandi, Weilacher & Young

[57] ABSTRACT

An image forming apparatus is provided with a binding function. A container, having a binding mechanism located in the bottom end thereof, is attached to the housing of the image forming apparatus. A guide member movable between a first positions in which the guide member is adjacent to the bottom end of the container, and a second position in which the guide member projects beyond the insertion opening of the container is provided to support a binder which is loaded in the container.

15 Claims, 17 Drawing Sheets

IMAGE FORMING APPARATUS EQUIPPED WITH A BINDING FUNCTION

This application is a divisional of co-pending application Ser. No. 07/790,765 filed on Nov. 12, 1991, now U.S. Pat. No. 5,275,520 which is incorporated entirely herein by reference.

CROSS-REFERENCE TO RELATED APPLICATION

The present application is related to the copending U.S. application Ser. No. 583,643, filed on Sep. 17, 1990 and now U.S. Pat. No. 5,143,503, commonly assigned with the present application.

BACKGROUND OF THE INVENTION

The present invention relates generally to a binding unit which binds a plurality of sheets in adherence to a binder.

FIGS. 23 and 24 show a conventional binding unit. The binder 40 used in this binding unit 46 includes an electric heater 42 and an adhesive layer 43 covering thee heater 42 over the inner surface of its spine 41. Electrodes 44 of a pair are provided on either end of the electric heater 42, and are exposed on the outer surface (the lower surface in the figures) of the spine 41.

The binding unit 46 includes a container 47 into which the binder 40 is loaded. A pair of electrode terminals 48 which come into contact with the electrodes 44 of the binder 40 is provided on the inner surface of the bottom of the container 47 whereby electric current is supplied to the electric heater 42 through the electrode terminals 48.

In order to bind sheets, the binder 40 is loaded into the container 47, and electric current is supplied to the electric heater 42 through the terminals 48 and electrodes 44. As a result, the adhesive layer 43 heals and melts, and one side of the stack of sheets 45 is adhered to the binder 40, whereby the stack of sheets 45 is bound.

For the purpose of sufficiently heating and melting the adhesive layer 43 in the conventional binding unit 46, it is important that the electrodes 44 of the binder 40 and the electrode terminals 48 be securely in contact with each other when the binder 40 is loaded in the container 47. Should foreign material such as dust or paper powder, however, enter the container 47 through the insertion opening for the binder and stick to the electrode terminals 48, defective contact might occur between the electrodes 44 of the binder 40 and the electrode terminals 48, leading to uneven or insufficient heating of the adhesive layer 43.

Particularly, when the binding unit 46 is provided in a copying machine and has the insertion opening directed upward, foreign material is liable to enter the binding unit 46 through the opening. Such foreign material remaining inside the binding unit 46 is impractical to remove.

Furthermore, a binding unit provided in a copying machine as disclosed in Japanese Utility Model Laying-Open No. 41261/1986 or Japanese Utility Model Laying-Open No. 121456/1986, is not allowed sufficient space for suitable mounting due to its positional relation to other elements, such as a sorter, or vent holes provided in a side wall of the machine body. Stable support of large-size sheets in the binder unit 46 is difficult in consequence, and an operator is left to support the sheets by hand in order to bind them reliably.

SUMMARY OF THE INVENTION

An object of the present invention is to prevent foreign material from entering the bottom portion of a binder container in a binding unit in order to minimize the occurrence of defective contact between electrodes or other unfavorable effects.

Another object is to ensure a good contact between electrodes of a binder and the binding unit electrode terminals, and to improve maintenance efficiency.

Still another object of the present invention is reliably to support the material to be bound by a binding unit in use, which when not in use occupies reduced space.

(1) A binding unit according to an aspect of the invention binds sheets through employment of a binder incorporating an electric beater and electrodes for supplying electric current to the electric heater. This binding unit includes a container and an inner lid. One end of the container is provided with an entrance through which a binder is loaded, and another end is provided with electrode terminals which come into contact with electrodes of a binder. The inner lid is openable and disposed above the electrode terminals within the container. The inner lid is in a closed position covering the electrode terminals when no binder is loaded in the container, and in an open position, permitting contact of the electrodes of the binder with the electrode terminals and supporting one side of the binder, when the binder is loaded in the container.

Since the inner lid is in the closed position covering the electrode terminals when no binder is loaded in the container, though foreign material should enter the container through the container opening, it is prevented from dropping onto the electrode terminals, averting defective contact between the electrodes. When a binder is loaded in the container, it pushes the inner lid into its open position wherein the lid retains one side of the binder. The binder is thus stably positioned in the container and the electrodes are set into secure contact.

(2) A binding unit according to another aspect of the invention includes a container, a binding device, and an inner lid. The container has a binder entrance at one end, and an opening different from the entrance. The binding device is disposed in the bottom portion of the container and activates the binding operation of a binder loaded in the container. The inner lid is provided to complete a path extending from within the container to the non-entrance, opening and to cover the binding device when no binder is loaded in the container.

Should foreign material enter the container through the binder entrance, it passes clear through the container and is discharged through the opening, and is blocked from entering the bottom portion of the container in which the binding device is located. When a binder is loaded in the container, the inner lid is thus opened, allowing the binder to reach the bottom portion of the container.

(3) An image forming apparatus according to yet another aspect of the invention includes an image forming unit, an apparatus body containing the image forming unit, a container, and a guide mechanism. The image forming unit prints an image onto a sheet. The container is mounted in a portion of the apparatus body, and has an open entrance through which material to be bound is loaded, and a binding device furnished in its bottom end. The guide mechanism is capable of assuming a first position in which it is located along the bottom end, and a second position in which it projects beyond the open end and supports one side of the material loaded in the container.

Since the guide mechanism is thus located along its bottom end widen no sheets to be bound are loaded in the container, the height of the entire binding unit can be reduced so that the binding unit does not obstruct, for example, ventilation of the image forming apparatus. When sheets are to be bound, the guide mechanism projects beyond the opening end of the container to support one side of the material placed in the container. Thus the guide mechanism is capable of securely supporting and stably positioning large size sheets.

(4) A binding unit according to a further aspect of the invention includes a container and a lid. One end of the container has an opening through which a binder is loaded, and the opposite end is provided with a binding device. The lid is openable and provided within the opening of the container, and includes a guide portion which guides a binder toward the binding device. The lid supports one side of the binder loaded in the container when the lid is in its set-open state.

The lid prevents foreign material such as dust from entering the container when no binding operation is underway, whereby the binding device within the container is protected against the consequences foreign material intrusion.

When a binder is loaded into the container, the binder is guided toward the binding device therein. One side of the binder when loaded in the container is supported by the guide portion of the lid, whereby the binder is stably positioned during a binding operation.

(5) A binding unit according to a further aspect of the invention includes a container, electrode terminals, and a mounting portion. One end of the container has an opening through which a binder is loaded. The electrode terminals are provided in the opposite another end of the container, and comprise supports and elastic contacts which are elastically deformed when in full contact with the electrodes of the binder. The mounting portion is provided in the bottom of the container and has cavities wherein the supports of the electrode terminals are detachably retained.

Due to the fact that the electrode terminals comprise the supports and the contacts as described and the supports are detachably set into the cavities of the container, the electrode terminals can be easily attached to and detached front the container. Furthermore, since the contacts of the electrode terminals deform elastically and are thus pushed toward the electrodes of the binder by agency of their elastic force when the electrodes of the binder are in full contact with them, secure contact between the electrodes of the binder and the electrode terminals is ensured.

The foregoing and other objects and advantages of the present invention will be more note fully apparent from the following detailed description.

DESCRIPTION OF THE PREFERRED EMBODIMENTS

First Embodiment

Figure 1:
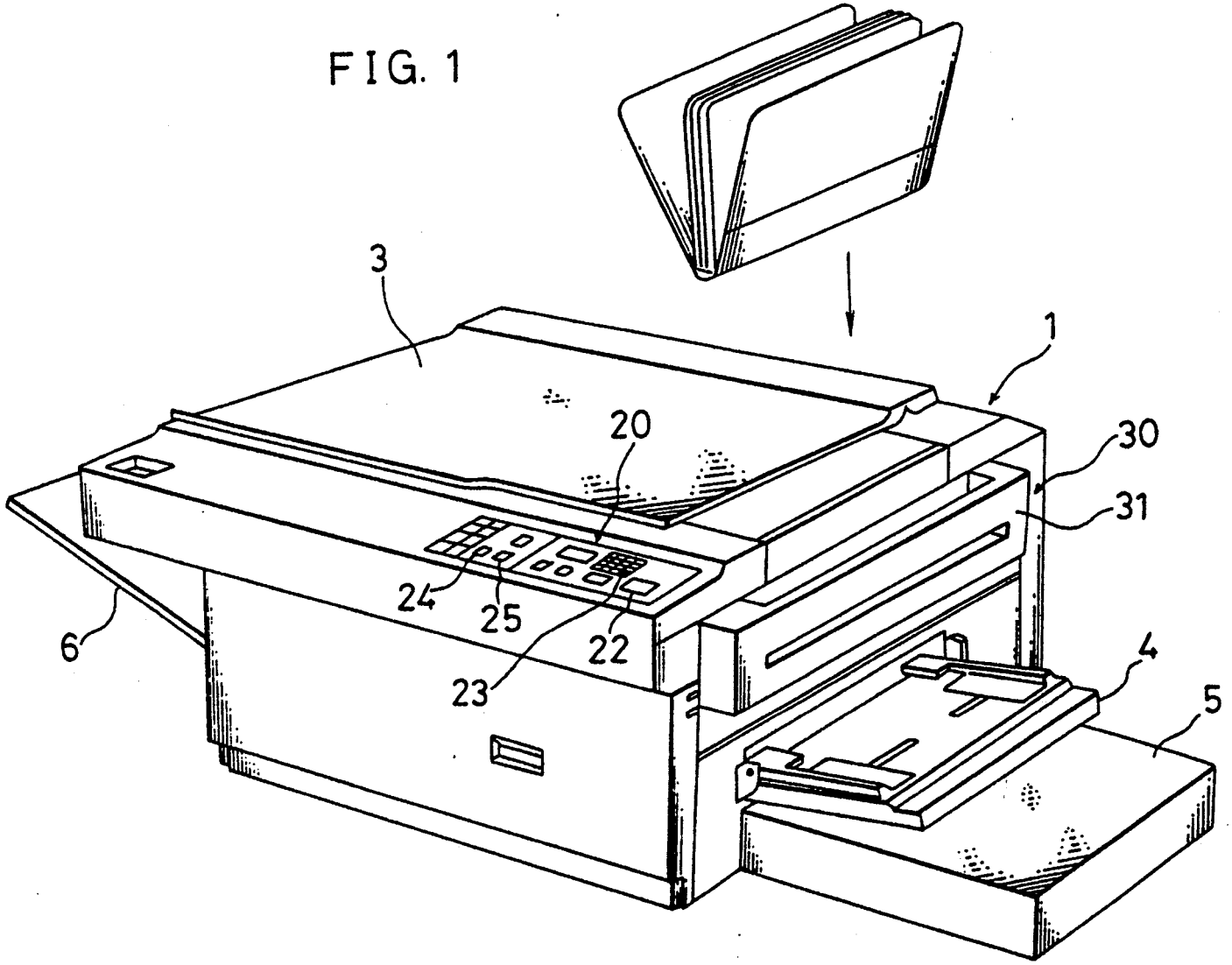
FIG. 1 is a perspective view of a copying machine equipped with a binding unit according to a first embodiment of the invention.
Figure 2:
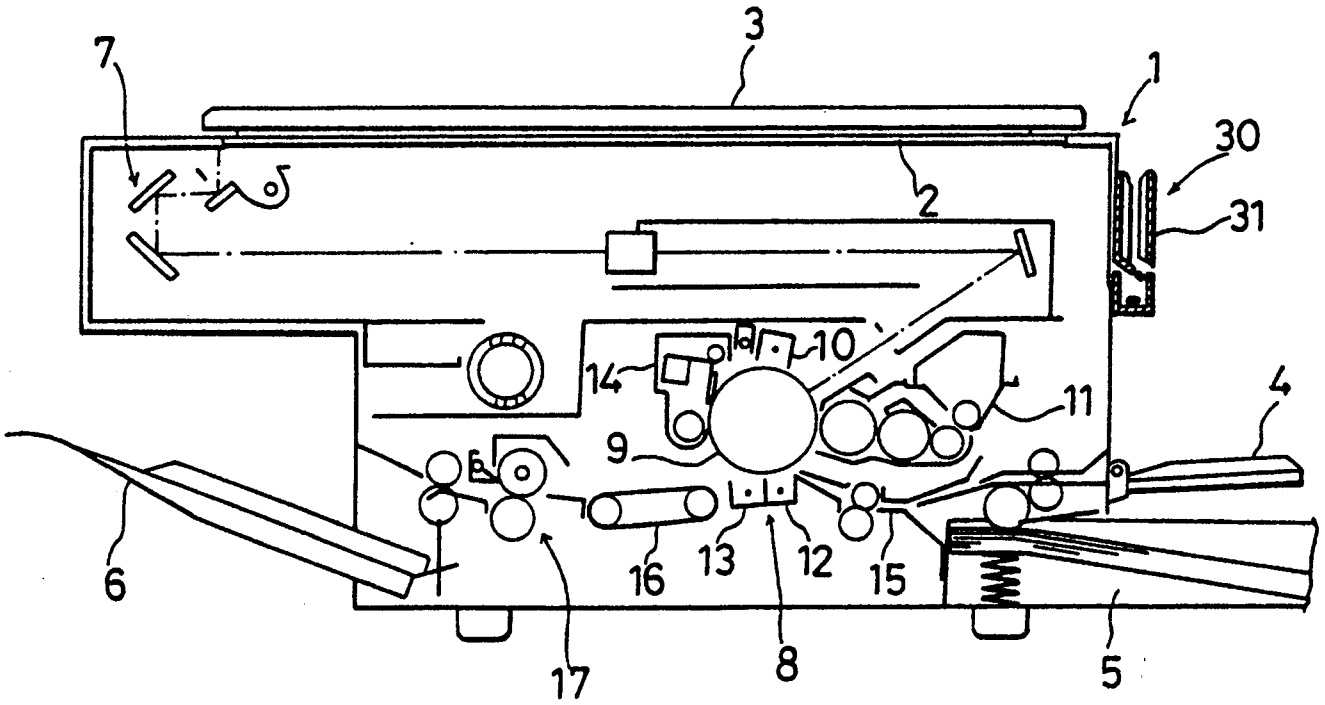
FIG. 2 is a schematic elevational view of the FIG. 1 copying machine.

FIGS. 1 and 2 show a copying machine equipped with a binding unit according to the first embodiment of the invention.

With reference to these figures, an original retainer 2 is incorporated into the upper surface of a copying machine body 1, and an openable original cover 3 is disposed on the original retainer 2. A feed tray 4 and a feed cassette 5 are provided on the right side of the machine body 1 and are detachable. A copy tray 6 to which copy-processed sheets are discharged is provided on the left side of the machine body 1.

An optical exposure system 7 for the scanning of originals is disposed in an upper portion of the machine body 1. The optical exposure system 7 includes a light source, mirrors, and related elements. An image forming unit 8 is provided in a central portion of the machine body 1. A photoconductive drum 9 on which an electrostatic latent image is formed is disposed in the middle of the image forming unit 8. A main charger 10, a developing unit 11, a transfer charger 12, a separation charger 13, a cleaning unit 14, and related elements are disposed surrounding the photoconductive drum 9. A sheet transport path 15 including a plurality of transport rollers extends from the feed tray 4 and feed cassette 5 to the image forming unit 8. A discharged sheet transport system 16 and a fixing unit 17 are provided between the image forming unit 8 and the copy tray 6.

Figure 3A:
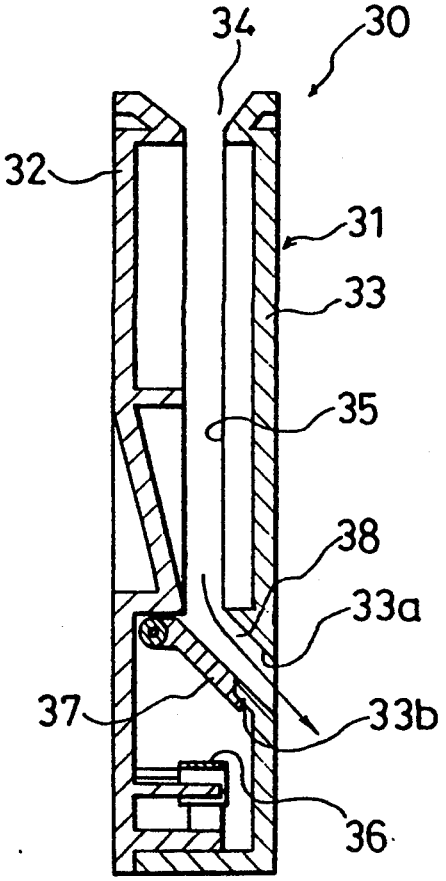
FIG. 3A is a sectional view of the binding unit.

A binding unit 30 is provided on the machine body 1 along its upper right portion. The binding unit 30 includes a container 31 into which a binder is loaded. Referring to FIG. 3A, the container 31 includes a first case 32 fixed to the machine body 1 by screws, and a second case 33 attached to the first case 32 also by screws. The upper end of the container 31 has an opening 34 through which a binder is received. A housing 35 which retains the loaded binder is formed in the container 31. The second case 33 has an outlet 33a in communication with the housing 35.

A pair of electrode terminals 36 is provided in the bottom of the container 31. One of the electrode terminals is nearer the front of the machine, and the other is nearer the rear of the machine. These electrode terminals 36 are provided in order to lake contact with corresponding electrodes 44 (to be described afterwards) of a binder 40.

Figure 3B:
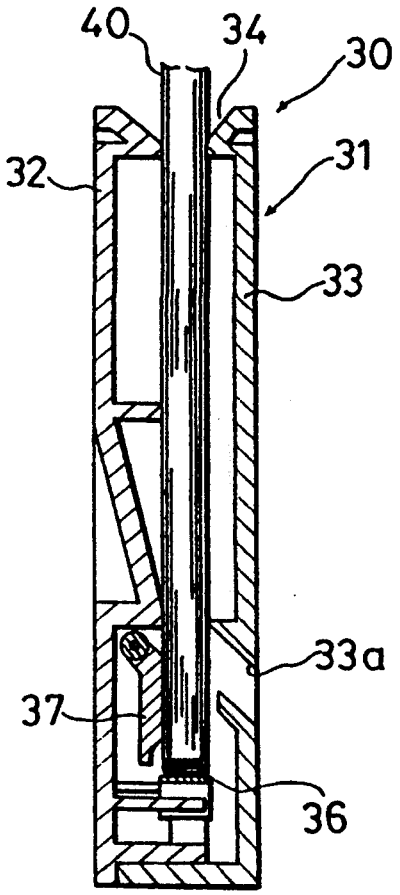
FIG. 3B is a sectional view of the binding unit in operation.

An inner lid 37 is provided above the electrode terminals 36. One edge of the inner lid 37 is hinged rotatably by the first case 32. The lid 37 is impelled counterclockwise in FIG. 3A by means of an impelling member such as a spring. The opposite edge of the inner lid 37 is pressed against a stop 33*b* in a lower portion of the outlet 33*a* of the second case 33, whereby counterclockwise rotation of the lid 37 is limited. Thus, the inner lid 37 closed is as shown in FIG. 3A and opened is as shown in FIG. 3B. When the inner lid 37 is in the closed position, its top end impelled against the stop 33*b* is lower than the hinged portion, whereby a sloped path from the housing 35 to the outlet 33*a* is formed.

Figure 4:
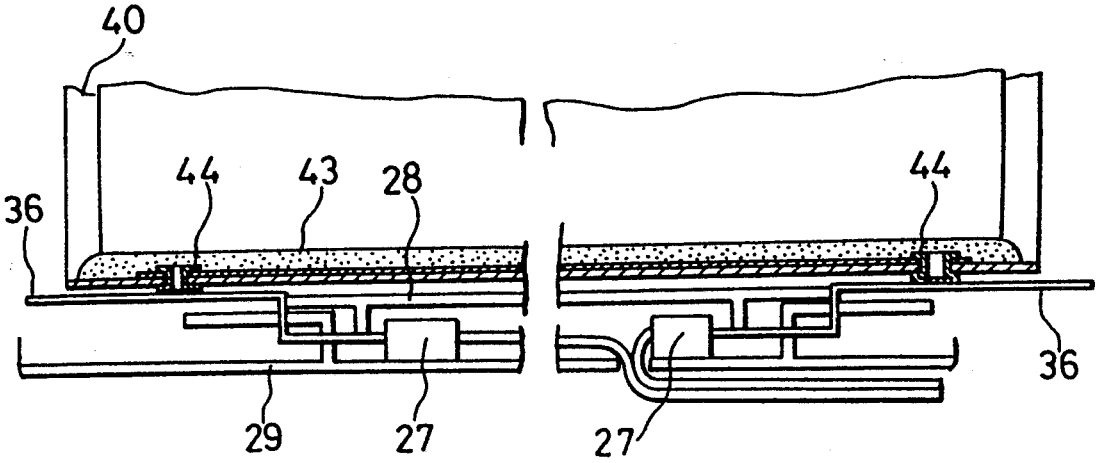
FIG. 4 is a partly in sectional view of a electrode terminals support structure of the binding unit.
Figure 5:
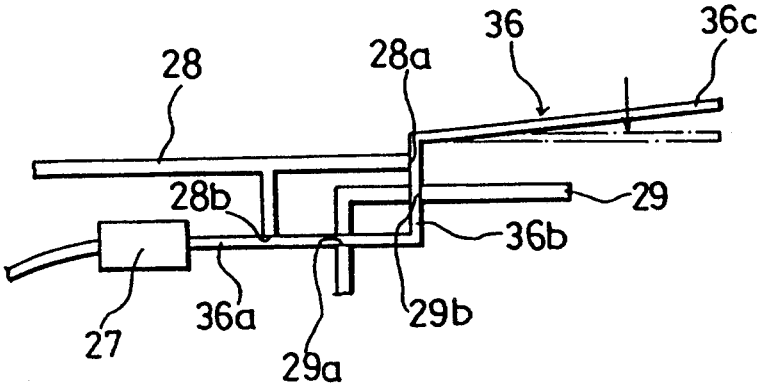
FIG. 5 is an enlarged partial view of the support structure.

FIGS. 4 and 5 show the electrode terminals 36 and supports thereof.

Each terminal 36 is formed of a bent conducting strip as shown. It includes a horizontal support 36*a*, a vertical support 36*b*, and a contact 36*c* comes into contact with the corresponding electrode 44 of the binder 40. A plug 27 is connected to the horizontal support 36*a* of each electrode terminal 36, through which voltage is applied.

The horizontal and vertical supports 36*a* and 36*b* are seated into notches 29*a* and 29*b*, respectively, formed in a rib 29 of the first case 32, whereby the electrode terminals 36 are fixed. Both ends 28*a* of a horizontal portion of another rib 28 of the first case 32 buttress the vertical supports 36*b* of the electrode terminals 36, and the lower end 28*b* of a vertical portion projecting downward from the horizontal portion of the rib 28 abuts against the horizontal support 36*a*, whereby the electrode terminals 36 are held fast against turning. Alternatively, the ribs 28 and 29 may be formed in the second case 33.

As can be seen in FIG. 5, which shows the contact 36*c* when not in contact with the corresponding electrode 44 of the binder 40, the contact 36*c* is sloped such that its outer end is higher. When the binder 40 is loaded in the container 31, the contact 36*c* becomes essentially horizontal under elastic deformation, as shown by a partially dotted line in FIG. 5, and thus it applies elastic force upward.

As shown in FIG. 1, an operation panel 20 is provided in a front portion on top of the machine body 1. The operation panel 20 includes a print key 22 for instructing the start of a copying operation, a ten-key board 23 for designating the number of copies, a heating-state lamp 24 for indicating the beating state of the binding unit 30, and a cooling-state lamp 25 for indicating the cooling state thereof, and other related elements.

Figure 6:
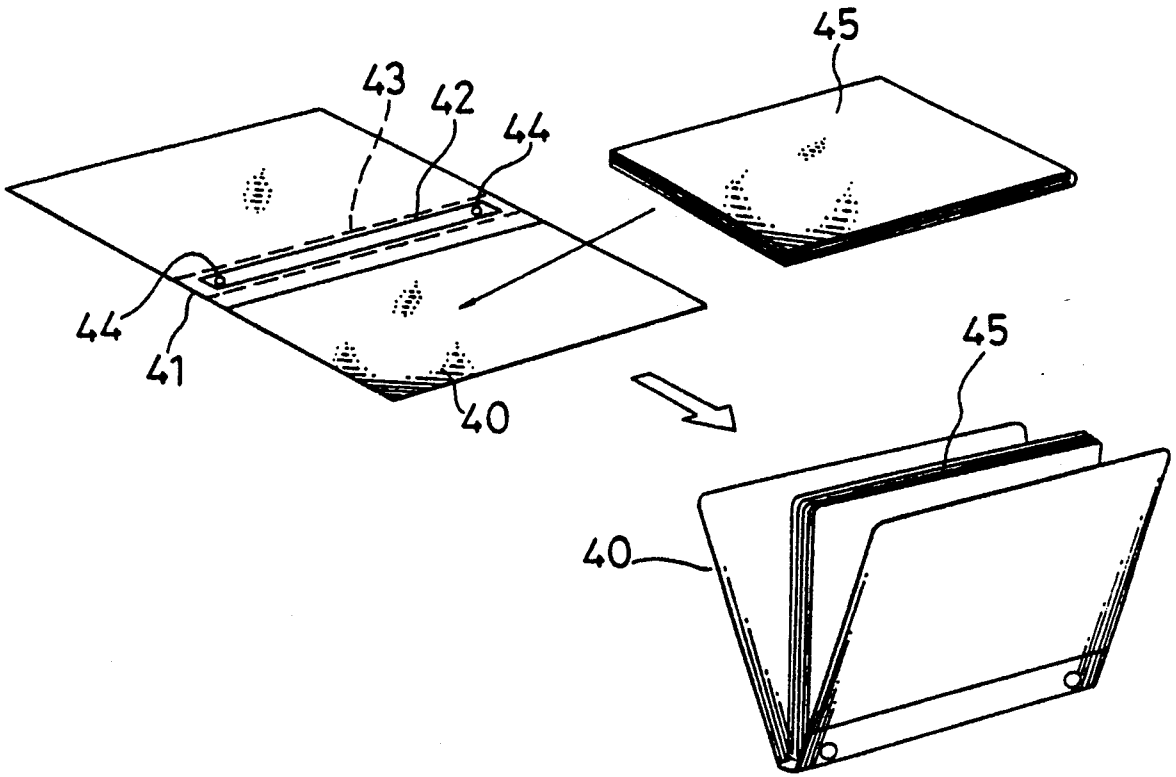
FIG. 6 is a perspective view of a binder.

FIG. 6 illustrates the binder 40. The binder 40 includes an electric heater 42 and an adhesive layer 43 covering the heater 42 over the inner surface of its spine 41. Electrodes 44 of a pair are provided on both ends of the electric heater 42, and are exposed on the outer surface (i.e., the lower surface in the figure) of the spine 41.

In time copying machine thus structured, a copying operation is performed in the same manner as in conventional copying machines.

In the binding unit 30, time opening 34 for the binder is directed upward and, accordingly, is liable to the entrance of foreign material such as dust. When no binding operation is performed, time inner lid 37 is held closed by means of the impelling member as shown in FIG. 3A thereby shielding the electrode terminals 36. Herein the inner lid 37 forms the path 38 connecting the housing 35 with the outlet 33*a*, and any foreign material entering time housing 35 is discharged outside through the path 38.

In the above-described structure, the binding unit 30 functions principally to bind sheets copy-processed by the copying machine. As shown in FIG. 6, first, a stack of copy-processed sheets 45 is placed in the binder 40, bringing one side of the stack into contact with the adhesive layer 43 along the spine 41. Then the binder 40 is folded and inserted into the container 31, Therein, the spine 41 of the blinder 40 pushes against the inner lid 37. As time binder 40 is further inserted downward, the inner lid 37 is rotated downward against the impelling force of the impelling member. When the binder 40 reaches the bottom of the container 31 as shown in FIG. 3B, the electrodes of the binder 40 are brought into contact with the terminal electrodes 36. The electrode terminals 36 are thus brought into electrical connection with the electric heater 42 through the electrodes 44.

Since the contacts 36*c* of the electrode terminals 36 slope slightly upward in their free state, upward elastic force is applied to the electrode terminals 36 when fully in contact with the electrodes 44 of the binder 40 such tits, the contacts 36*c* are flattened. Thus, secure contact between the electrodes 44 and terminals 36 is ensured. In the state wherein the binder 40 is set into the housing 35 as shown in FIG. 3B, the inner lid 37 pushes the binder 40 rightward, thus staying it. Accordingly, the binder 40 is stably positioned, further ensuring that the electrodes 44 and 36 are securely in contact with each other.

When the binder 40 is loaded into the container 31 and contact between the electrodes 44 and the electrode terminals 36 is detected, electric current is supplied through the electrode terminals 36. As a result, the electric heater 42 of the binder 40 heats, melting the adhesive layer 43. Consequently, the given side of the stack of sheets 45 is adhered to the binder 40 by the adhesive layer 43.

The heating-state lamp 24 on the operation panel 20 of the copying machine body 1 is illuminated while the heating process of the binding operation is underway. When the heating process terminates, the heating-state lamp 24 switches off and the cooling-state lamp 25 switches on. After the cooling process, the cooling-state lamp 25 switches off.

When it becomes necessary to replace the electrode terminals 36 after a long period of use, the first case 32 is removed from the second cage 33 after loosening the screws. Next, the electrode terminals 36 are withdrawn from the ribs 29 of the first case 32. The electrode terminals 36 are detached from the plugs 27, and then may be replaced.

The electrode terminals 36 are easily withdrawn from the ribs 29 of the first case 32, thus facilitating their maintenance.

Second Embodiment

Figure 7A:
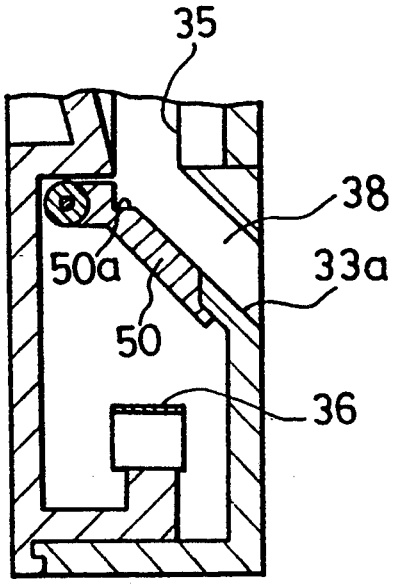
FIGS. 7A and 7B are sectional views of a binding unit according to a second embodiment of the invention.
Figure 7B:
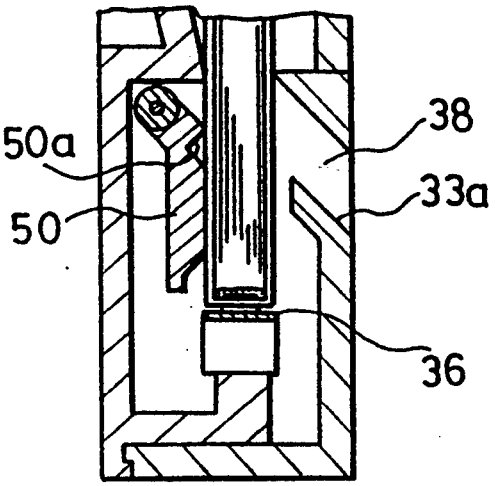

FIGS. 7A and 7B i illustrate the second embodiment. The structure of the copying machine body is the same as that of the first embodiment.

According to the invention in the second embodiment, the upper surface of the inner lid 50 is provided with a notch 50*a* along that portion immediately beneath the housing 35. The notch 50*a* is met by the spine 41 of the binder 40 and is pressed downward when the binder 40 is loaded. Thus, when the binder 40 is inserted into the container 31, the spine 41 of the binder 40 first pushes against the notch 50*a*, thereby ensuring smooth rotation of the inner lid 50.

If the notch 50*a* is overly large, foreign material dropping into the housing 35 might remain in the notch 50*a* and would not be discharged to the outlet 33*a*. Therefore, the notch 50*a* must be of appropriate size.

Third Embodiment

Figure 8A:
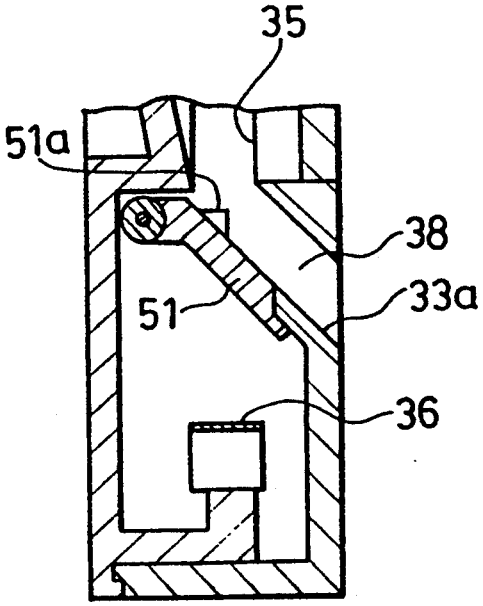
FIGS. 8A and 8B are sectional views of a binding unit according to a third embodiment of the invention.
Figure 8B:
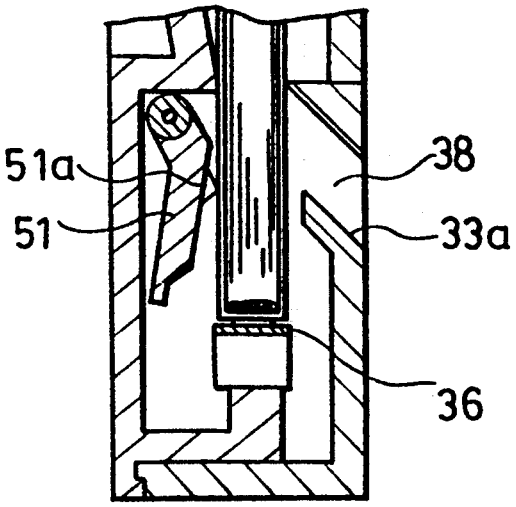

FIGS. 8A and 8B illustrate the invention in the third embodiment.

The structure of the copying machine body is the same as that in the first embodiment.

According to the third embodiment, the upper surface of the inner lid 51 is provided with protecting nibs 51*a* which serve the same purpose as in the second embodiment. The nibs 51 are spaced in alignment along the width direction of the copying machine body 1. In lieu of the plurality of nibs 51*a*, an integrally formed rib extending along the width direction may be provided.

Fourth Embodiment

Figure 9A:
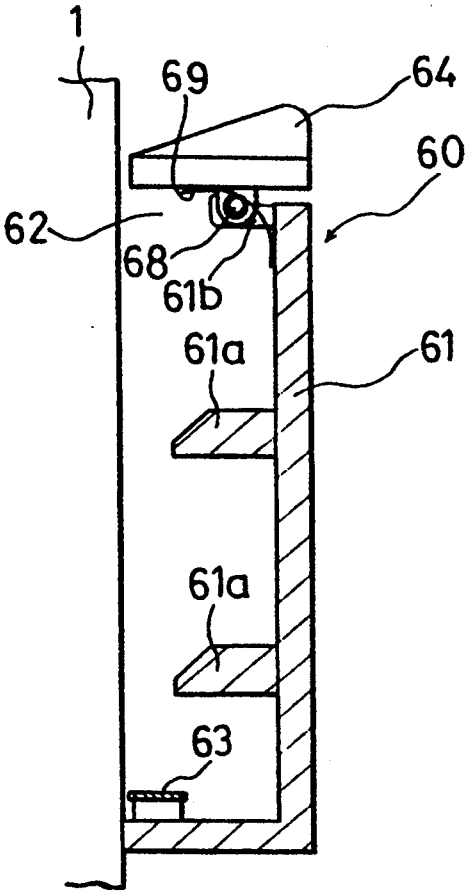
FIGS. 9A and 9B are sectional views of a binding unit according to a fourth embodiment of invention.
Figure 9B:
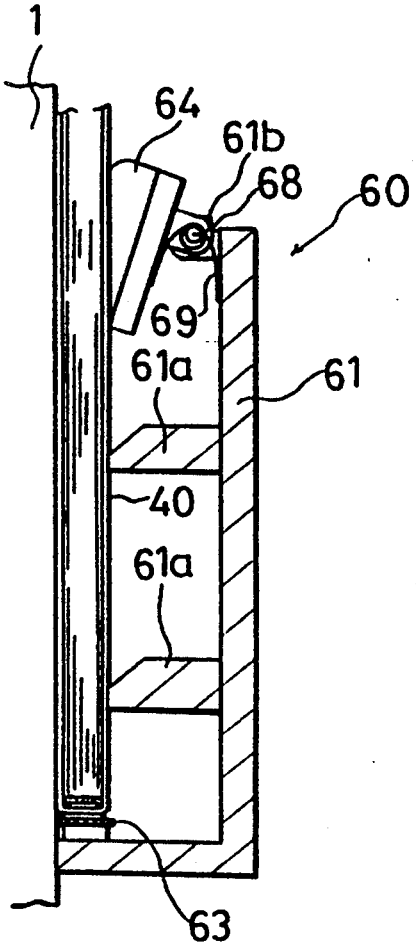

FIGS. 9A and 9B illustrate a binding unit 60 according the fourth embodiment, The structure of the copying machine body is the same as that in the above-described embodiments.

The binding unit 60 includes a container 61 into which a binder 40 is loaded. A plurality of ribs 61*a* projecting horizontally are provided on the inner surface of a side wall of the container 61. These ribs 61*a* buttress one side of a binder inserted in the container 61. The container 61 has an opening 62 at its upper end, through which a binder 40 is inserted. A pair of electrode terminals 63 is provided on the inner side of the bottom of the container 61. The electrode terminals 63 are disposed at the front and rear, in terms of the copying machine layout, so as to come into contact with the electrodes of the binder 40.

Figure 10:
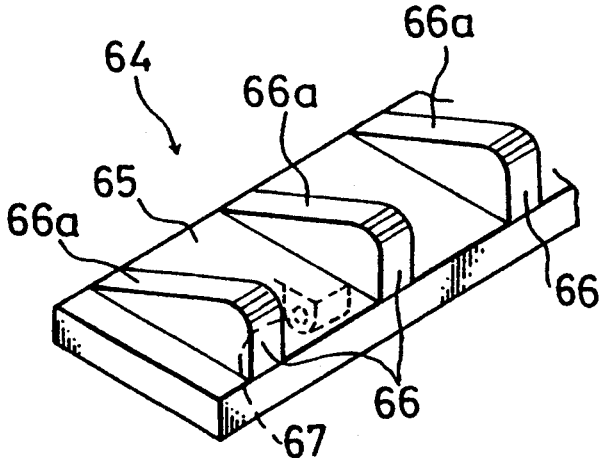
FIG. 10 is a partial perspective view of a lid of a binding unit according to the fourth embodiment.

An openable lid 64 is provided over the opening 62 of the container 61. Referring to FIG. 10, the lid 64 comprises a flat body 65, and a plurality of guide ribs 66 formed at prescribed intervals along the upper surface of the body 65. A boss 67 is provided on the lower surface of the flat body 65. The lid 64 thus is rotatably supported by a bracket 61*b* at the upper end of the container 61 by means of a pin 68 through the boss 67. The lid 64 is positioned so as to shut the opening 62 as FIG. 9A by means of a spring 69 attached to the pin 68. Each guide rib 66 of the lid 64 is substantially triangular in form. The inclined surfaces 66*a* of the guide ribs 66 guide the binder 40 toward the electrode terminals 63. When the lid 64 is opened as shown in FIG. 9B, the inclined surfaces 66*a* of the guide ribs 66 abut on one side of the binder 40.

Although the opening 62 would allow dust or other foreign material to enter the binding unit 60, the lid 64 is held shut by the force of the spring 69 while no binding is underway, thus covering the container 61. Therefore, dust or other foreign material can scarcely drop down onto the electrode terminals 63, guaranteeing that there will be good contact between the electrodes of the binder 40 and the electrode terminals during the binding operation.

In order to perform a binding operation, a slack of copy-processed sheets is placed in the binder 40 as shown in FIG. 6, and then the binder 40 is loaded into the container 61. The spine of the binder 40 slides along the sloped guide ribs 66 of the lid 64 and thus is guided to the side wall of the copying machine body 1. The binder 40 is then pushed further downward, whereby the lid 64 is rotated (counterclockwise in FIG. 9A) in opposition to the impelling force of the spring 69. The binder 40 is guided by the guide ribs 66 and the side wall of the copying machine body 1 toward the electrode terminals 63 at the bottom of the container 61. When the binder 40 reaches the bottom of the container 61 as shown in FIG. 9B, the electrodes of the binder 40 are brought into contact with the electrode terminals 63, thus establishing electrical connection between the electrode terminals 63 and the electric healer 42.

While the binder 40 is set as shown in FIG. 9B, one side of the binder 40 is buttressed by the ribs 61*a* in the container 61 and the inclined surfaces 66*a* of the lid 64, Since the lid 64 presses the binder 40 against the copying machine body 1 by means of the torsion spring 69, the binder 40 is stably positioned, securing the contact of the electrodes of the binder 40 with the electrode terminals 63 in the state shown in FIG. 9B.

The binder 40 is loaded into the container 61 and contact between the electrodes of the binder 40 and the electrode terminals 63 is detected, whereupon electric current flows between the electrode terminals 63. Thus, the electric heater 42 of the binder 40 heals, melting the adhesive material 43. As a result, the given side of the slack of sheets is adhered to the binder 40 by the adhesive material 43.

In this embodiment, dust or other foreign material as prevented from entering the container 61 by the lid 64 provided over the opening 62. By means of the guide ribs 66 of the lid 64, the binder 40 is guided into correct positioning, and when the binder 40 is set in the container 61, it is thus securely supported by the guide ribs 66.

Fifth Embodiment

Figure 11:
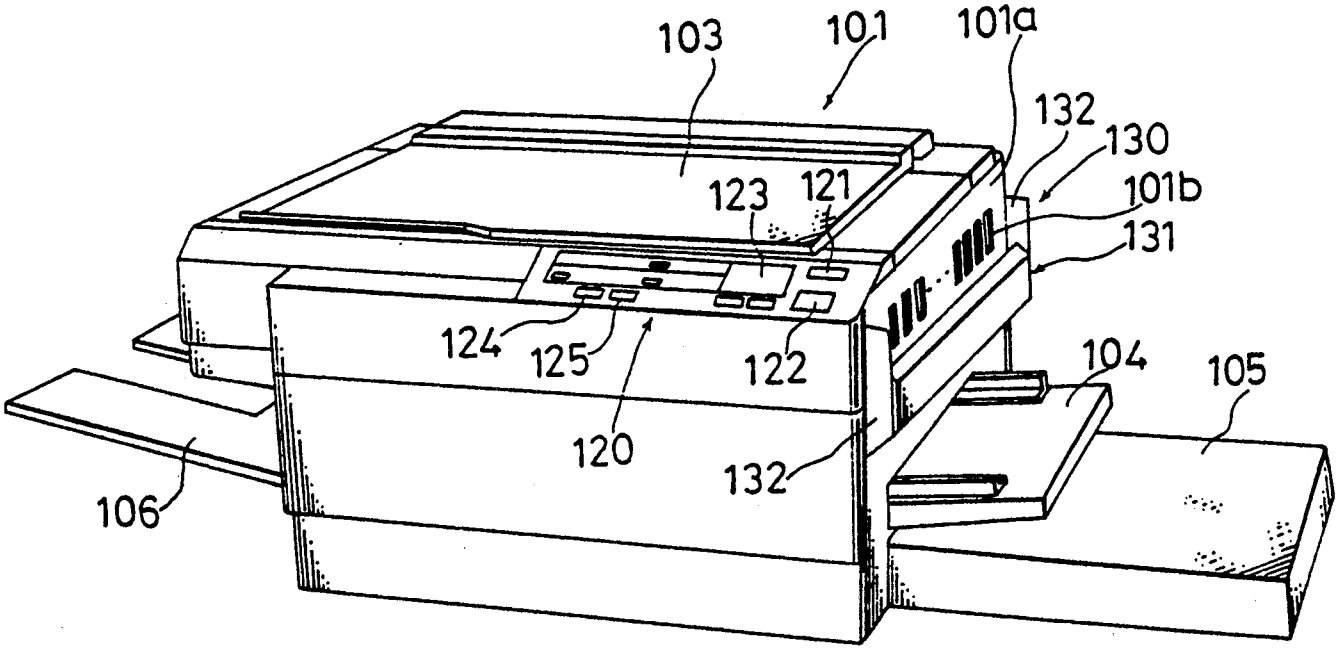
FIG. 11 is a perspective view of a copying machine equipped with a binding unit according to a fifth embodiment of the invention.
Figure 12:
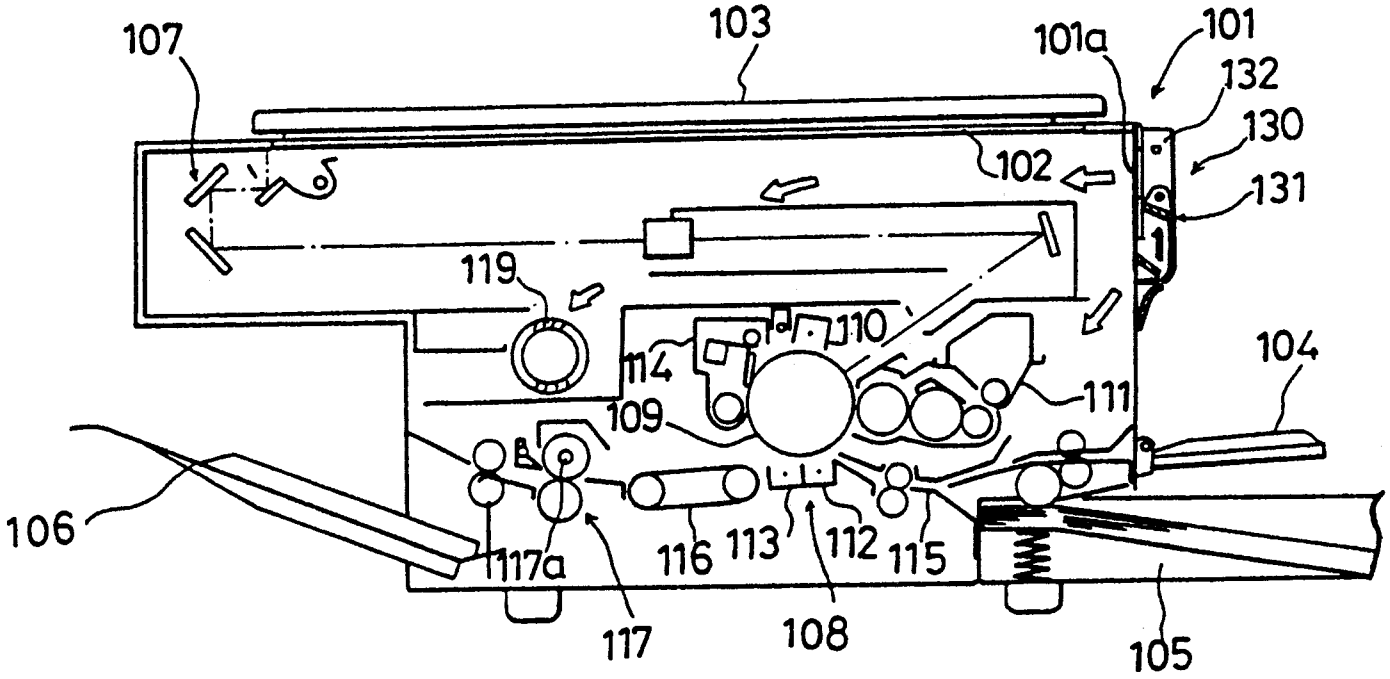
FIG. 12 is a schematic elevational view of the FIG. 11 copying machine.

FIGS. 11 and 12 show a copying machine equipped with a binding unit 130 according to the fifth embodiment.

Referring to these figures, an original retainer 102 incorporated in the upper surface of the copying machine body 101, and an openable original cover 103 is disposed over the original retainer 102. A feed tray 104 and a feed cassette 105 are provided on the right side of the copying machine body 101 and are detachable. A copy tray 106 onto which copy-processed sheets are discharged is provided on the left side of the copying machine body 101. An optical exposure system 107 for the scanning of originals is provided in an upper portion of the machine body 1. The optical exposure system 107 includes a light source, mirrors and related elements. An image forming unit 108 is provided in a central portion of the copying machine body 101. A photoconductive drum 109 on which an electrostatic latent image is formed is disposed in the middle of the image forming unit 108. A main charger 110, a developing unit 111, a transfer charger 112, a separation charge 113, a cleaning unit 114 and related elements are provided surrounding the photoconductive drum 109. A sheet transport path 115 including a plurality of transport rollers extends from the feed tray 104 and feed cassette 105 to the image forming unit 108. A discharged sheet transport system 116 and a fixing unit 117 are provided between the image forming unit 108 and the copy tray 106. The fixing unit 117 contains a fixation heater 117*a*. A ventilating turbine 119 which ventilates the copying machine body 101 is provided between the fixing unit 117 and the optical exposure system 107, and air intake holes 101*b* are provided in an tipper portion of a right side cover 101*a* on the machine body 101. By the rotation of turbine 119, air within the machine body 101 is discharged toward the rear of the machine.

Figure 13A:
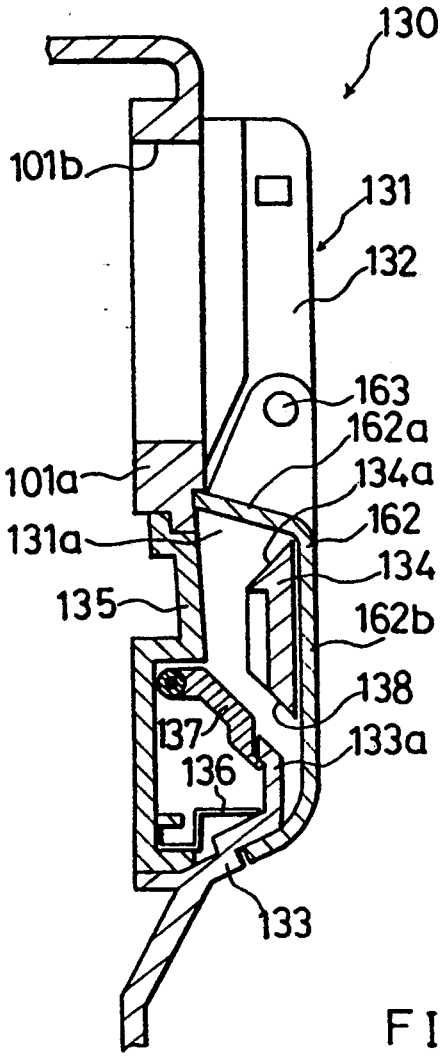
FIG. 13A is a sectional view of the binding unit of the fifth embodiment.
Figure 14:
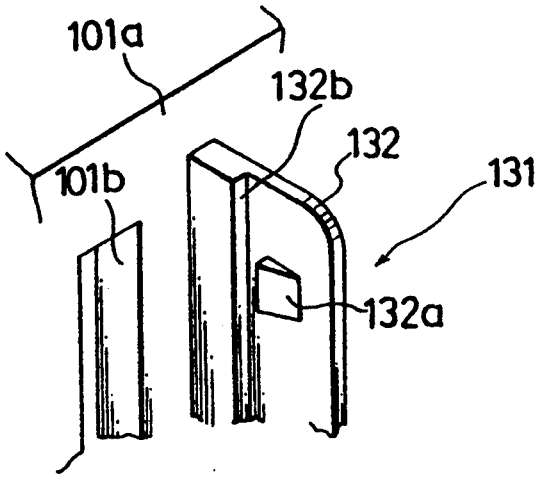
FIG. 14 is a partial perspective view of the binding unit.

A binding unit 130 is provided above the feed tray 104 on a portion of the right of the body 101 in FIGS. 11 and 12. Referring now to FIGS. 13A and 14, the binding unit 103 includes a container 131 into which a binder is loaded. The container 131 has front and rear side portions 132, a bottom portion 133, and binder support members 134 and 135. The container 131 is provided with an opening 131*a* through which a binder is introduced.

The front and rear side portions 132 constitute front and rear side walls of the container 131, which have a predetermined width therebetween and extend vertically. The binder support 134 connects the opposite inner walls of the front and rear side portions 132. An inclined portion 134*a* on which a binder is guided forms the upper surface of the binder support 134. The front and rear side portions 132, the bottom portion 133, and the binder support 134 are integrally formed with the side cover 101*a* in the machine body 101.

The support member 135 is located under the vent holes 101*b* of the side cover 101*a*. The support member 135 is provided with an inner lid 137. Under the inner lid 137, a pair of electrode terminals 136 is disposed in the bottom portion of the support member 135. The electrode terminals 136 are disposed at the front and the rear, in term of the machine layout, so as to come into contact with the electrodes 44 of the binder 40 (FIG. 6).

An edge of the lid 137 is rotatably supported on the support member 135 by means of a shaft extending perpendicular to the plane of FIG. 13A. The inner lid 137 is impelled counterclockwise by means of an impelling member such as a spring (not shown). The opposite edge of the inner lid 137 thus presses against a stop 133*a* extending upward from the bottom portion 133, completing an outlet 138 provided above the stop 133*a*, under the binder support 134. The upper surface of the inner lid 137 is continuous with the outlet 138.

Figure 13B:
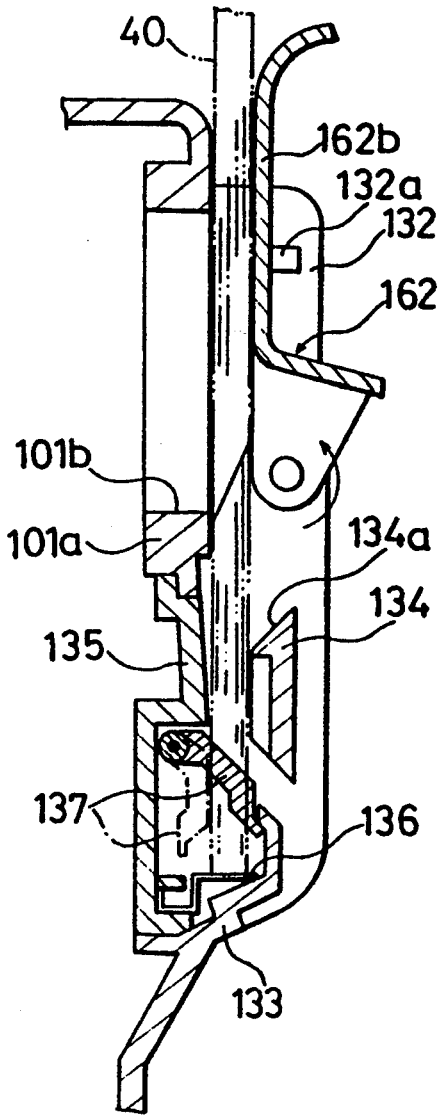
FIG. 13B is a sectional view of the binding unit operation.

A guide member 162 is provided between the front and rear side portions 132 of the container 131, and is rotatably supported on a pin 163. The guide member 162 includes a sloped lid portion 162*a*, and a support portion 162*b* extending vertically. The lid portion 162*a* covers the bottom region of the container 131 when the guide member 162 is in a first position as shown in FIG. 13A. The support portion 162*b* abuts against one side of the binder 40 when the guide member 162 assumes a second position as shown in FIG. 13B. The top end (in FIG. 13B) of the support portion 162*b* is curved, thereby facilitating insertion of the binder 40. A projection 132*a* triangular in plan view is formed on the upper inner wall of each of the front and rear side portion 132, as shown in FIG. 14. The projection 132*a* constitutes a wedge the thicker end of which is toward the machine body 101. A stepped portion 132*b* is provided along the edge of either of the front and rear side portions 132 closest to the machine body 101. The projection 132*a* and the stepped portion 132*b* together serve to retain the guide member 162 in the second position.

Figure 15:
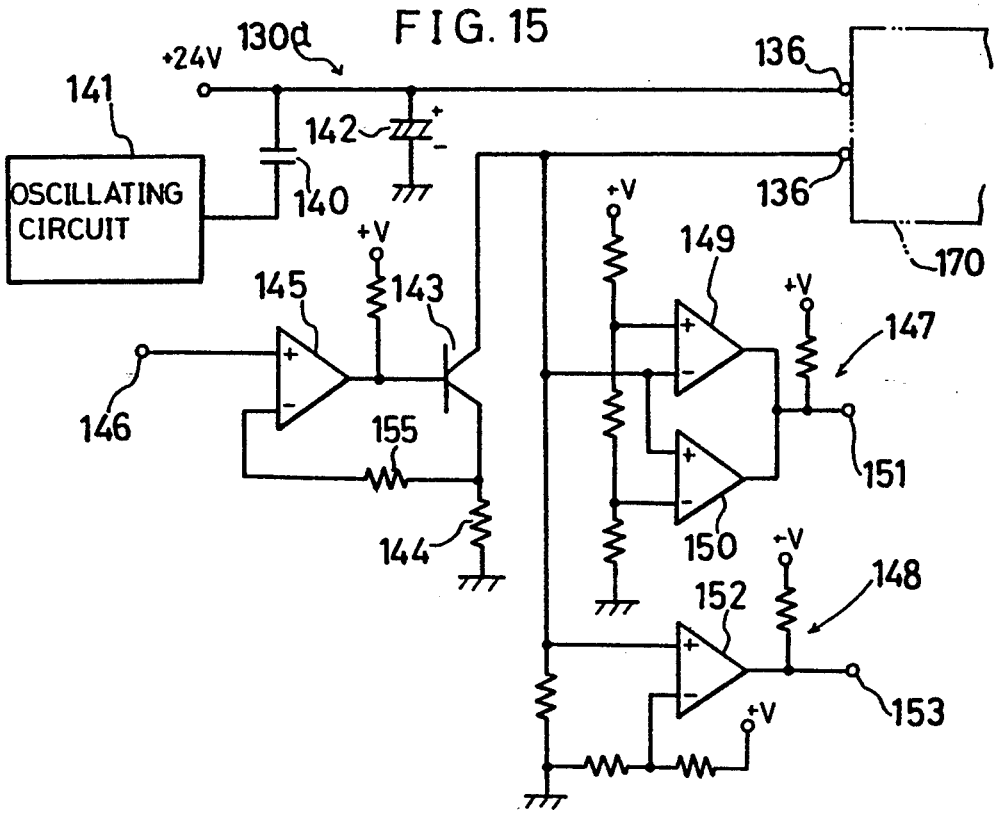
FIG. 15 is a circuit diagram of the binding unit.

The binding unit 130 includes a control circuit 130*a*, diagramed in FIG. 15. Referring to FIG. 15, a power source of +24 V is connected to one of the electrode terminals 136. An oscillating circuit 141 is connected between the +24 V power source and this electrode terminal 136 through a capacitor 140. A storage capacitor 142 for storing electric charge is also connected therebetween. The collector of a power transistor 143 is connected to the oilier electrode terminal 136. The emitter of the power transistor 143 further is grounded through a resistor 144. The output terminal of a comparator 145 is connected to the base of the power transistor 143. A remote terminal 146 is connected to a non-inverting terminal of the comparator 145. The emitter of the power transistor 143 further is connected to the inverting terminal of the comparator 145 through a resistor 155.

A malfunction detection circuit 147 and a start detection circuit 148 are provided between the power transistor 143 and the latter of the two electrode terminals 136. The malfunction detection circuit 147 includes a pair of comparators 149 and 150, and generates a high output at an "NG" terminal 151 only when the collector voltage of the power transistor 143 is within a prescribed normal range. The start detection circuit 148, which includes a comparator 152, generates a high output at a start terminal 153 upon detection of an increase in the collector voltage of the power transistor 143.

As shown in FIG. 11, an operation panel 120 is provided on the right front corner of the upper surface of the copying machine body 1. The operation panel 120 includes a liquid crystal display (LCD) 121 for displaying operation conditions such as the number of copies and operational timings. The operation panel 120 further includes a print key 122 for instructing a copy process start, a ten-key board 123 for designating the number of copies, a heating-state lamp 124 for indicating the heating state of the binding unit 130, and a cooling-state lamp 125 for indicating the cooling state thereof.

Figure 16:
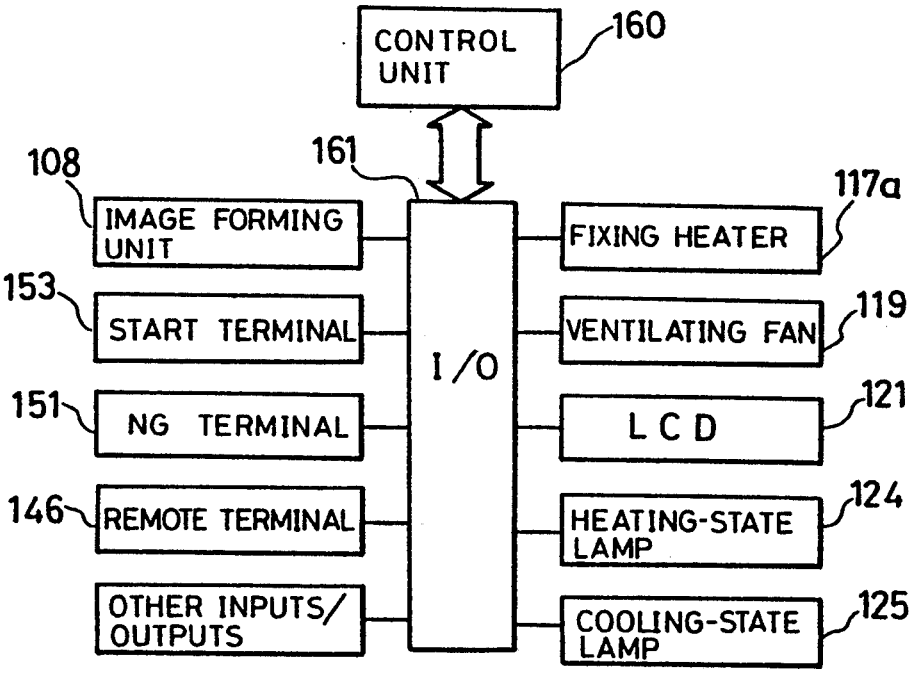
FIG. 16 is a schematic block diagram of a control unit to the binding unit.

A control unit 160 as shown in FIG. 16 is provided in the copying machine according to the present embodiment. The control unit 160 includes a microcomputer consisting of a CPU, an ROM, an RAM and other related devices. The control unit 160 contains an I/O port 161 connected with the image forming unit 108 including the developing unit 111, the fixation heater 117*a* of the fixing unit 117, the ventilation turbine 119, the liquid crystal display 121, the heating-state lamp 124, the cooling-state lamp 125, and miscellaneous inputs and outputs. Further connected with the I/O port 161 are the remote terminal 146, the NG terminal 151 and the start terminal 153 of the control circuit 130*a* to the binding unit 130.

Figure 17:
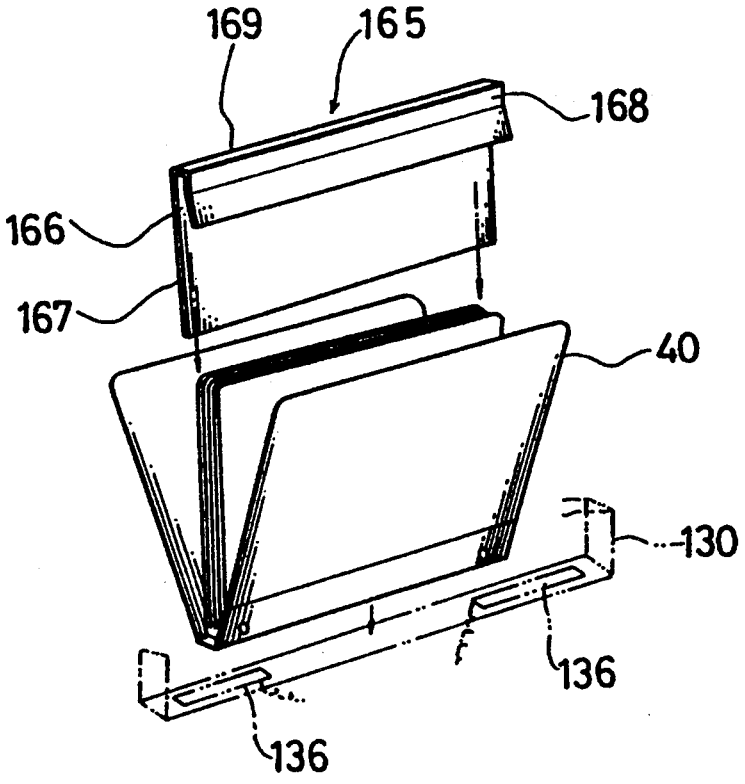
FIG. 17 is a perspective view of a binder and a sheet loading assist member of the fifth embodiment.

The same binder 40 as in the above-described embodiments is employed in the binding operation of this embodiment. Additionally, a sheet insertion assist member 165 as shown in FIG. 17 is utilized for the binding operation.

The sheet insertion assist member 165 is a bent metallic plate fashioned as a J in cross section. The bent portion of the plate constitutes an insertion opening 166 into which one side of a stack of sheets is inserted. Thus the sheet insertion assist member 165 consists of a longer lateral plate portion 167 and a shorter side plate portion 168 on either side of the insertion opening 166, as well as a sheet alignment portion 169 joining the lateral plate portions 167 and 168. One side of a stack of sheets inserted in the member 165 is set flush with the sheet alignment portion 169.

The height of the sheet insertion assist member 165 is essentially equal to that of the binder 40, and the width of the insertion opening 166 of the member 165 is slightly less than the thickness of the binder 40. The lateral plate portions 167 and 168 are of such dimension that their corresponding ends reach the side cover 101*a* and the support portion 162*b* of the guide member 162, respectively, wherein a binder 40 is set into the sheet insertion assist member 165 and is loaded in the container 131.

In the binding unit 130 thus structured, the guide member 162 is in the first position as shown in FIG. 13A wherein no binding operation is underway. The lid portion 162*a* of the guide member 162 prevents dust or other foreign material from entering the bottom portion of the container 131. Should any foreign matter manage to enter into the container 131, it is guided to the outlet 138 along the tipper surface of the inner lid 137, which prevents the foreign matter from dropping onto the electrode terminals 136 provided in the bottom of the container 131. When the guide member 162 is in the first position, nothing covers the air intake holes 101*b* of the side cover 101*a* in the machine body 101, allowing the machine body 101 to be ventilated without obstruction.

When a binding operation is to be performed, the guide member 162 is rotated counterclockwise from the first position shown in FIG. 13A. Then, the side edges of the support portion 162*b* of the guide member 162 pass against the projections 132*a* of the front and rear side portions 132, and become engaged within the gap between the projections 132*a* and the stepped portions 132*b*. As a result, the guide member 162 is retained into the second position as shown in FIG. 13B.

A stack of sheets 45 is inserted into the binder 40 with one side of the slack in contact with the adhesive layer 43 along the spine 41, in the same manner as in the above-described embodiments (as shown in FIG. 6). The binder 40 is then folded.

The sheet insertion assist member 165 is slid over the upper portion or the stack of sheets as shown in FIG. 17, whereby the slack of sheets is driven downward under its weight, resulting in firmly seating of the corresponding side of the stack of sheets flush with the adhesive layer 43.

Thereafter, the binder 40 is inserted into the container 131 along the support portion 162*b* of the guide member 162 in the second position. The spine of the binder 40 then pushes against the inner lid 137, rotated downward against the impelling force of the impelling member. When the spine of the binder 40 reaches the bottom of the container 131 as shown in FIG. 13B, the electrodes 44 of the binder 40 come into electrical contact with the electrode terminals 136.

When the binder 40 is loaded in the container 131, the binder 40 it is not subject to bending, since the sheet insertion assist member 165 is firmly retained between the side walls of the container 131, owing to the structural features of the assist member 165, namely that the width or the insertion opening 166 is slightly less than the thickness of the binder 40, and the lateral plate portions 167 and 168 are of sufficient dimension to reach the side cover 101*a*, and the side portion 162*b* of the guide member 162, respectively. The stack of sheets is thus held firmly flush with the adhesive layer 43 of the binder 40.

In order to rotate the guide member 162 from the second position as shown in FIG. 13B to the first position as shown in FIG. 13A after a binding operation, the front and rear side portions 132 are forced outward, and then the guide member 162 is drawn out from the gap between the projections 132*a* and stepped portions 132*b*, and rotated clockwise (downward). The guide member 162 is thus brought into the first position, in which it covers the bottom of the container 131.

Figure 18A:
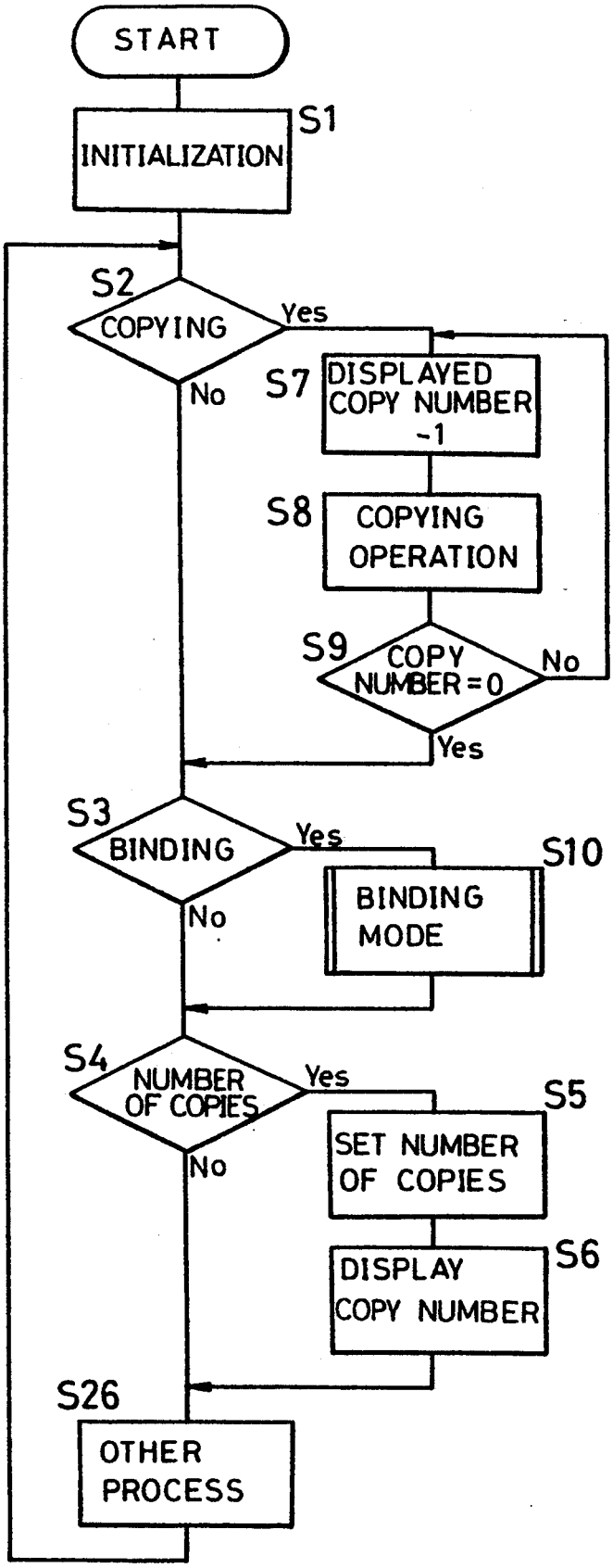
FIGS. 18A and 18B are control flow charts of the fifth embodiment.

The control program of this embodiment will now be described with reference to the flow charts of FIGS. 18A to 18B.

When the program starts, an initialization procedure is carried out at step S1, wherein, for example, the fixation heater 17*a* of the fixing unit 117 is set to a prescribed temperature and the turbine 119 is driven to rotate at a prescribed speed. The turbine 119 consequently brings about cooling ventilation with the copying machine body 101, as indicated by the arrows in FIG. 12. When the binding unit. 130 is not in use, the air intake holes 101*b* are not covered by the guide member 162 and binder 40, and the machine body 101 is smoothly ventilated without obstruction.

After initialization, it is determined at step S2, whether copying operation start instruction has been issued through the print key 122. If no instruction has been issued, the program proceeds to step S3, at which it is determined by reference to a signal from the start terminal 153 whether or not the binding mode is to be started. If is not, the program proceeds to step S4. At step S4, it is determined whether a copy number setting instruction has been issued through the ten-key board 123. If no such instruction has been issued, miscellaneous processes are executed at step S26, and then the program returns to step S2.

If the ten-key board 123 has been pressed in order designate a certain number of copies, the program proceeds from step S4 to step S5, whereby an input value corresponding to the number of copies is stored. At step S6, the number of copies is indicated on the liquid crystal display 121. After the process of step S6, the program returns to the main routine.

When the print key 122 is pressed, the program proceeds from step S2 to step S7. At step S7, "1" is subtracted front the copy number indicated on the liquid crystal display 121 and the resulting quantity is indicated on the liquid crystal display 121.

At step S8, a copying operation is started. In the copying operation, an original on the original retainer 102 is scanned by the optical exposure system 107, and the image information obtained through the scan is supplied to the image forming unit, wherein the corresponding image is transferred onto a sheet transported from the feed tray 104 or feed cassette 105. The image transferred onto the sheet is fixed by the fixing unit 117 and the sheet is discharged into the copy tray 106. After each copying operation in a sequence, it is determined at step S9 whether the displayed number is "0" or not. If it is not "0", indicating that copying operations of the designated number have not been completed, the processes at steps S7 and S8 are executed again, If the determination S9 is "Yes", the program returns to the main routine.

In order to bind copy-processed sheets, the guide member 162 is set into the second position as described above, and the binder 40 seated into and clipped by the sheet insertion assist member 165 is inserted into the container 131. When the electrode terminals 136 are brought into electrical connection as a result of the insertion of the binder 40, the potential at the non-inverting terminal of the comparator 152 of the start detecting circuit 148 rises, and a high level signal is generated at the start terminal 153 of the control circuit 130*a* to the binding unit 130. In consequence, the binding mode of the control unit 160 is begun, and the program proceeds from step S3 to step S10, entering the bicycling mode subroutine shown in FIG. 18B.

Figure 18B:
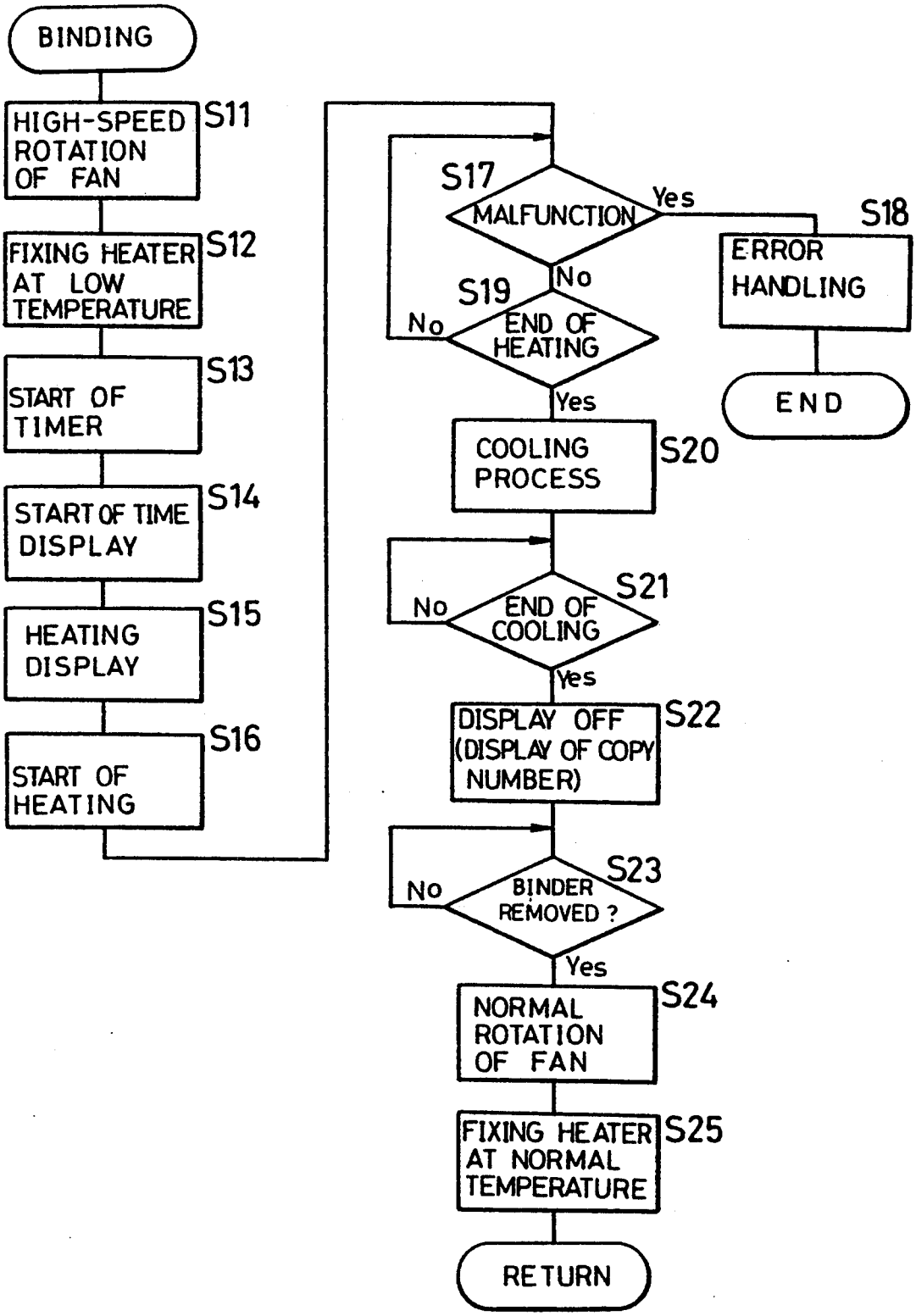

In the binding mode subroutine charted in FIG. 18B, the rotating speed of the turbine 119 is increased at step S11. Consequently, the ventilating capacity of the turbine 119 increases. At this stage, the binder 40 is loaded into the binding unit 130 as shown in FIG. 13B, whereby the air intake holes 101*b* become covered. As a result, air cannot flow smoothly into the copying machine body 101 through the holes 101*b*. However, since the ventilating capacity of the turbine 119 has been increased, the copying machine body 101 remains sufficiently ventilated.

At step S12, the set temperature of the fixation heater 117*a* of the fixing unit 117 is lowered slightly. Since the temperature in the machine body 101 tends to increase due to the interception of the air intake holes 101*b* by the binder 40, the temperature of the healer 117*a* is set slightly lower for the purpose of maintaining normality in the fixing operation of the fixing unit 117 and a normal temperature within the machine body 101.

At step S13, clocking by a timer starts. At step S14, indication on the liquid crystal display 121 of the time remaining until the end of a binding operation is begun. At step S15, the heating-state lamp 124 switches on. At step S16, a high level signal is outputted to the remote terminal 146. As a result, the power transistor 143 of the binding unit 130 switches on, whereby electric current flows between the pair of electrode terminals 136, Consequently, the electric healer 42 of the binder 40 heats melting the adhesive material 43. The slack of sheets is thus adhered to the binder 40 by the adhesive material 43.

The electric power supplied to the healer 12 is regulated by a feedback circuit comprising the resistor 155 to the comparator 145. Any indication of a malfunction, such as an abnormal resistance value of the electric heater 42 or defective contact between the binder 40 and the electrode terminals 136, is detected by the malfunction detection circuit 147. If the potential at the collector of the power transistor 143 goes outside the normal range as defined by the pair of comparators 149 and 150, the output at the NG terminal 151 drops. The change in output at the NG terminal 151 is detected at step S17 of FIG. 18B. When a malfunction is thus detected, the program proceeds front step S17 to step S18, performing error indicating operations including cutoff of the supply of electric power to the electrode terminals 136 and the indication of "ERROR" on the liquid crystal display 121.

If no real function is detected by the malfunction detection circuit 147 during the healing process begun at step S16, the program proceeds from step S17 to step S19. At step S19, it is determined whether a predetermined heating time has elapsed, by reference to the timing of the timer started at step S13. Pending elapse of the predetermined heating time, the program returns to step S17. Upon the elapse of the heating period, the program proceeds from step S19 to step S20, at which a cooling-related process is carried out. This process includes cutoff of electric power to the electrode terminals 136, switching the heating stale lamp 124 off, and illuminating the cooling-state lamp 125.

At step S21, the program pauses until the predetermined cooling time has elapsed. With the elapse of the cooling period, the program proceeds to step S22, at which the time indication by the liquid crystal display 121 and the cooling-state lamp 25 are switched off. The liquid crystal display 121 returns to displaying the copy number. After the process of step S22, the program proceeds to sleep S23. At step S23, it is determined whether the binder 40 has been removed from the binding unit 130. The removal of the binder 40 is detected when the collector voltage of the power transistor 143 drops and a low level signal is generated at the start terminal 153 as a result of the detachment of the electrodes of the binder 40 from the electrode terminals 136. Until the binder 40 is removed from the binding unit 130, the determination tit step S23 is "No", and the program does not proceed further.

When the binder 40 has been removed from the binding unit 30, the air intake holes 101*b* which had been covered by the binder 40 are unblocked, and the program proceeds to step S24, at which the rotating speed of the turbine 119 is returned to normal. At step S25, the temperature or the fixation healer 117*a* of the fixing unit 117 is reset to the prescribed normal temperature. After the process of step S25, the program returns to the main routine charted in FIG. 18A.

Sixth Embodiment

Figure 19A:
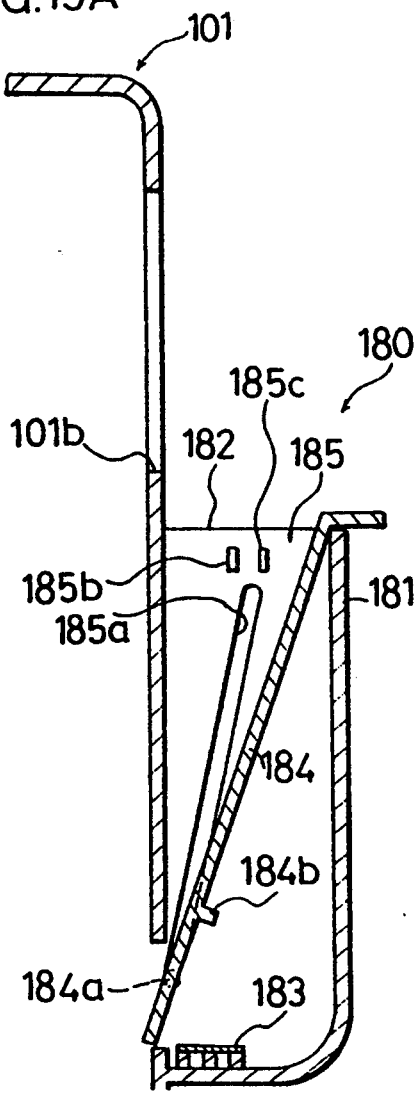
FIG. 19A and 19B are sectional views of a binding unit of a sixth embodiment.
Figure 19B:
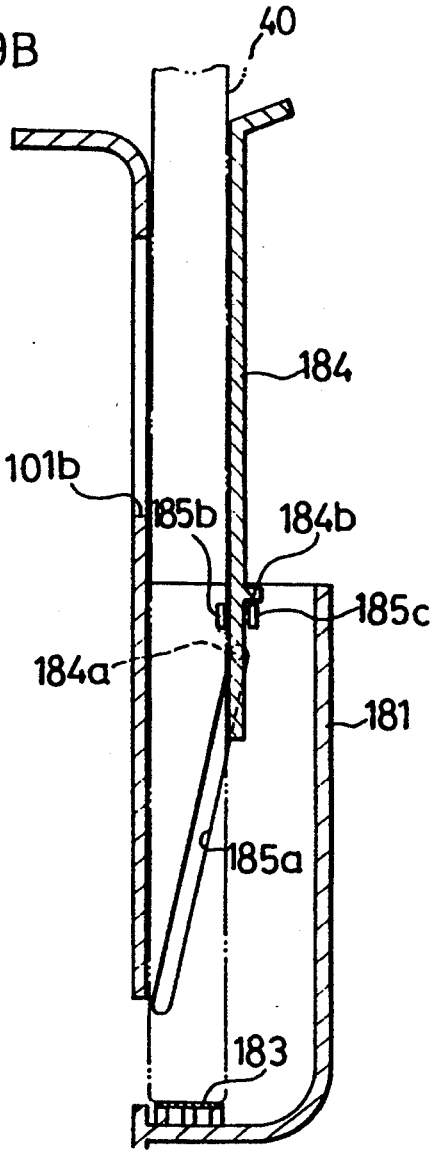
Figure 20:
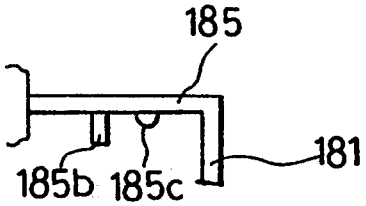
FIG. 20 is a fragmentary plan view of the binding unit of the sixth embodiment.

FIGS. 19A, 19B and 20 show a binding unit 180 according to the sixth embodiment. The binding unit 180 is provided on an upper portion of one side of the copying machine body 101. The structure of the copying machine body 101 is the same as that in the fifth embodiment.

The binding unit 180 includes a container 181 into which a binder 40 is loaded, The upper end of the container 181 has an opening 182 through which a binder 40 is inserted. The inner side of the bottom of the container 181 is provided with a pair of electrode terminals 183. The electrode terminals 183 are disposed so as to come into contact with the electrodes 44 of the binder 40.

A vertically slidable guide member 184 is provided in the container 181. The guide member 184 has lower lateral projections 184*a* in its lower portion which project from the front and rear edges of the member 184. The projections 184*a* slidably engage with grooves 185*a* formed in side portions 185 of the container 181. The guide member 184 as shown in FIG. 19A is in an inclined position covering the electrode terminals 183. Front and rear setting projections 184*b* projecting rightward (in FIGS. 19A and 19B) are formed on lower outer portions of the guide member 184. The setting projections 184*b* seat on a pair of projections 185*c* formed on the upper margins of the front and rear side portions 185. The projections 185*c* are shorter than associated retaining projections 185*b* as shown in FIG. 20, allowing the guide member 184 to "snap" over the projections 185*c* to thus become set between projections 185*b* and 185*c* on either side.

When no binding operation is underway in this binding unit 180, the guide member 184 is in the housed position as shown in FIG. 19A. The electrode terminals 183 are covered therein the guide member 184, which does not obstruct the air intake holes 101*b* of the copying machine body 1. Thus, the guide member 181 in the housed position serves to prevent foreign material from dropping down onto the electrode terminals 183, and at the same time allowing unobstructed ventilation of the machine body 101.

In order to carry out a binding operation, the guide member 184 is drawn out upward, whereby the projections 184*a* are slid alone the grooves 185*a*, and the sides of the guide member 184 snap over the projections 185*c* and are retained between the projections 185*b* and 185*c*. Due to the fact that setting projections 184*b* rest on the upper ends of the projections 185*c*, the guide member 184 is sustained in the position as shown in FIG. 19B. When a binder 40 is inserted into the binding unit 180 in this state, the binder 40 is guided along the guide member 184 and seats on the electrode terminals 183, whereupon the same binding operation as in the above-described embodiments is carried out. In the binding operation therein, the binder 40 is securely and stably supported by the adjacent surface of the guide member 184.

Seventh Embodiment

Figure 21A:
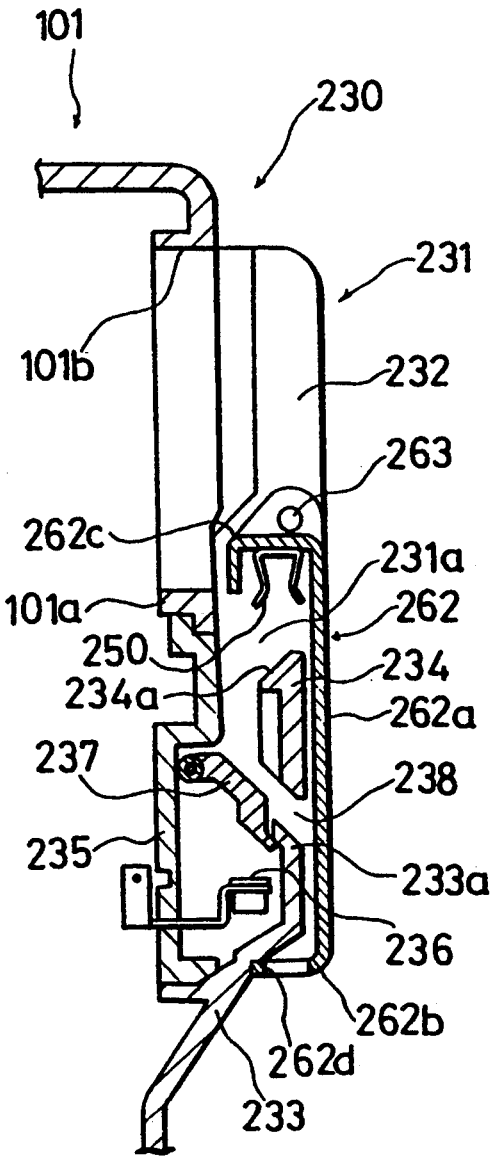
FIGS. 21A and 21B are sectional views of a binding unit of a seventh embodiment.
Figure 21B:
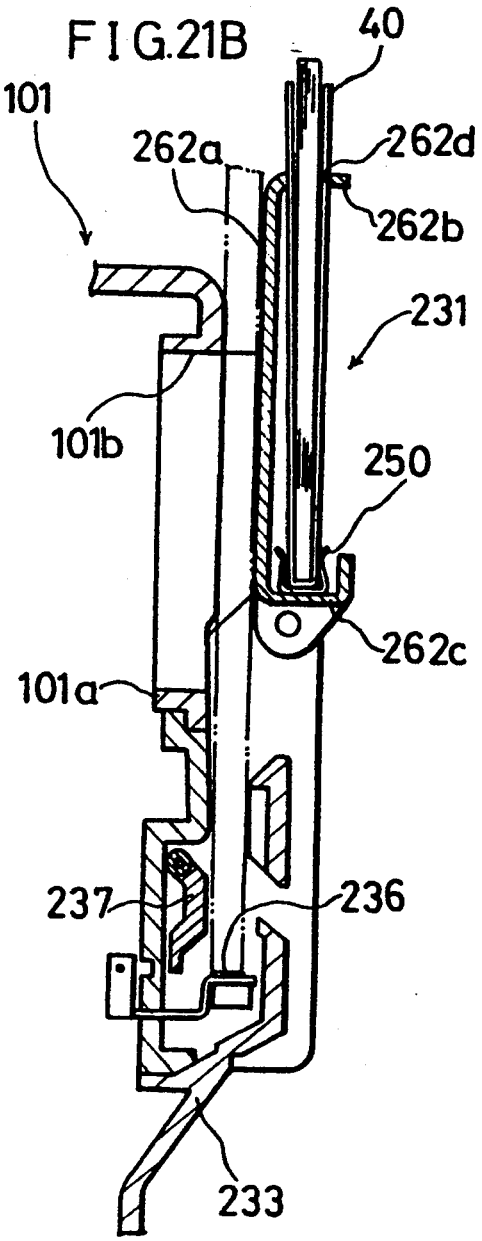
Figure 22:
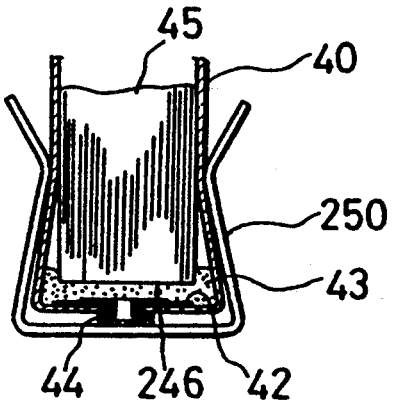
FIG. 22 is a partly in sectional view of the binding unit in operation.
Figure 23:
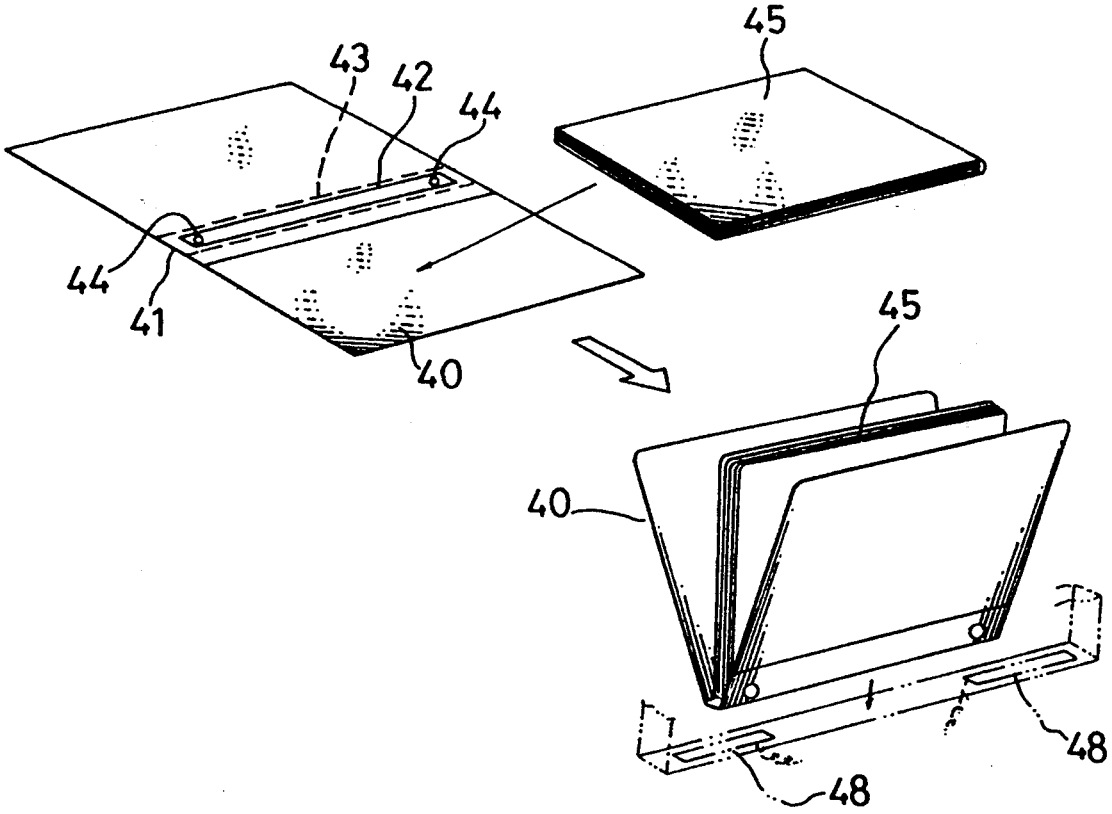
FIG. 23 (PRIOR ART)
FIG. 23 is a perspective view showing a conventional binding unit in use.
Figure 24:
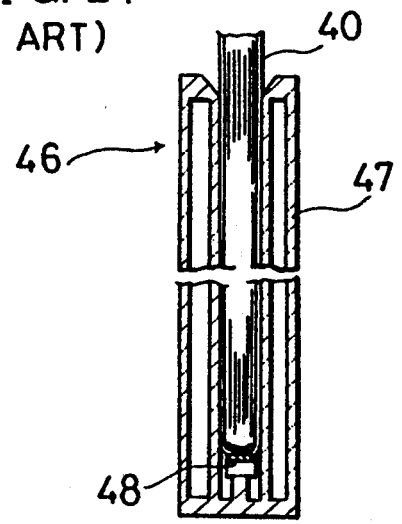
FIG. 24 (PRIOR ART)
FIG. 24 is a sectional view of the conventional binding unit.

FIGS. 21A, 21B and 22 show a binding unit 230 according to the seventh embodiment. The binding unit 230 is provided on an upper portion of one side of the copying machine body 101. The structure of the copying machine body 101 is the same as that in the sixth embodiment.

The binding unit 230 includes a container 231 into which a binder is loaded. The container 231 included front and rear side portions 232, a bottom portion 233, a binder support 234, and a support member 235. The container 231 includes an opening 231*a* through which a binder 40 is inserted.

The front and rear side portions 232 each have an elongate form of a predetermined width, and constitute front and rear side walls of the container 231. The binder support 234 provided connects the inwardly facing surfaces of the front and rear side portions 232. An inclined portion 234*a* for guiding a binder 40 during insertion is formed along the tipper surface of the binder support 234. The front and rear side portions 232, the bottom portion 233, and the binder support 234 are integrally formed with the side cover 101*a* of the copying machine body 101.

The support member 235 is fixed to a portion under air intake holes 101*b* of the side cover 101*a*. The support member 235 is furnished with an inner lid 237. A pair of electrode terminals 236 is provided on the inner side of the bottom of the support member 235. The electrode terminals 236 are disposed frontward and rearward in terms of the machine layout, so as come into contact with the electrodes of a binder. One of the longer edges of the inner lid 237 is rotatably mounted on the support member 235 by means of a shaft extending perpendicularly to the plane of FIG. 21A. The inner lid 237 is impelled counterclockwise by means of an impelling member such as a spring (not shown). The opposite of the longer edges of the inner lid 237 is pressed upward against a slop portion 233*a* projecting upward from a corresponding edge of the bottom portion 233. An outlet 238 is provided above the slop portion 233*a* and under the binder support 234. The upper surface of the inner lid 237 is continuous with the outlet 238.

The guide member 262 is rotatably mounted to the front and rear side portions 232 by means of a pin 263 perpendicular to the plane of FIG. 21A. The guide member 262 includes a covering portion 262*a*, a retaining portion 262*c* extending from one end (the upper end in FIG. 21A) of the covering portion 262*a*, and an insertion portion 262*b* formed on the other end of the covering portion 262*a*. The insertion portion 262*b* is provided with an opening 262*d* through which a binder 40 is inserted. The retaining portion 262*c* is provided with a U-shaped nipping member 250 formed of an elastic material (shown opening downward in FIG. 21A). When the guide member 262 is rotated upward for a binding operation, the nipping member 250 is opened upward as shown in FIG. 22, thereby to hold fast the adhered portion 246 of the binder 40 when it is inserted through the opening 262*d* as shown in FIG. 21B.

In order to carry out a binding operation in the binding unit 230, the guide member 262 is rotated upward from the state shown in FIG. 21A to the state shown in FIG. 21B. Subsequently, the binder 40 containing a stack of sheets 45 is inserted into the container 231. Then, the electrodes 42 of the binder 40 (shown in FIG. 22) are brought into contact with the electrode terminals 236, whereupon electric power is supplied to the electric healer 42 of the binder 40. Thus the electric heater 42 heats, melting the adhesive material 43 so that the stack of sheets 45 is bound.

After a predetermined period of supply of electric power to the binder 40, when its adhesive material is sufficiently healed and melted, it is removed from the container 231, Then, the binder 40 is inserted into the opening 262*d* of the guide member 262, as shown in FIGS. 21B and 22, wherein the adhered portion 246 of the binder 40 is nipped securely by the nipping member 250. The adhered portion 246 is cooled thus, ensuring that the slack of sheets 45 is uniformly adhered to the spine 41 of the binder 40.

Since the retaining portion 262*c* including the nipping member 250 is provided separately from the electrode terminals 236, the adhesive material 43 hardens efficiently in a relatively short period of time. While the adhesive material 43 is cooling, another binder 40 can be loaded into the container 231 in order that the adhesive material 43 may then be melted. Thus, the respective melting and cooling processes can be executed simultaneously, resulting in higher overall efficiency of the binding operations.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image forming apparatus equipped with a binding function, said apparatus comprising:

means for forming an image onto a sheet;

an image forming apparatus body housing said image forming means;

a container attached to said body, said container having an insertion opening at its upper end, through which a binder is inserted, and a binding means at its bottom end; and guide means movable between a first position in which said guide means is adjacent to the bottom end of said container, and a second position in which said guide means projects beyond said insertion opening so as to laterally support a binder loaded in said container.

2. An apparatus according to claim 1, wherein said container includes a pair of side walls disposed in a width direction of a binder when loaded, and said guide means is rotatably supported by said side walls.

3. An apparatus according to claim 2, wherein said guide means comprises a lid closing said container opening when said guide means is in the first position, and a support laterally supporting the side of the binder when said guide means is in the second position.

4. An apparatus according to claim 3, wherein said side walls of said container include position retaining means for retaining said guide means in said second position.

5. An apparatus according to claim 4, wherein said support constituting said guide means in the second position is provided with a curved portion for guiding said binder into said container.

6. An apparatus according to claim 2, wherein said side walls of said container include position retaining means for retaining said guide means in the second position.

7. An apparatus according to claim 1, wherein said image forming apparatus body includes a side cover, and a portion of said container is integrally formed with said side cover.

8. An apparatus according to claim 7, wherein said side cover includes air intake holes, and said guide means is disposed so as not to obstruct said air intake holes when said guide means is in the first position.

9. An apparatus according to claim 1 further comprising an openable inner lid within said container which is capable of assuming a closed position covering said binding means and an open position allowing a binder to come into contact with said binding means.

10. An apparatus according to claim 9, wherein said container includes a discharge opening in communication with the inside of said container, and said inner lid is disposed such that one of its surfaces forms a path between the inside of said container and said opening when said inner lid is in the closed position.

11. An apparatus according to claim 10, wherein said inner lid is disposed so as to support a reverse side of a binder wherein a given side is supported by said guide means when the binder is loaded in said container.

12. An apparatus according to claim 11, further comprising a binder support member, adjacent to said inner lid, for supporting the side of a binder supported by said guide means.

13. An apparatus according to claim 1, wherein the binder includes, along its spine, an electric heater, a thermoplastic adhesive layer, and electrodes for supplying electric current to said electric heater, and said binding means includes electrode terminals for contact with said electrodes of the binder.

14. An apparatus according to claim 13, further comprising an inner lid within said container which is capable of assuming an open position allowing said electrodes of a binder to come into contact with said electrode terminals, and supporting one side of the binder when the binder is loaded in said container.

15. An apparatus according to claim 14, wherein said container includes a discharge opening in communication with the inside of said container, and said inner lid is disposed such that one of its surfaces forms a path between the inside of said container and said opening when said inner lid is in the closed position.

* * * * *